US010293905B1

(12) United States Patent
Pelini

(10) Patent No.: US 10,293,905 B1
(45) Date of Patent: May 21, 2019

(54) BREAK AWAY JACK PLATE

(71) Applicant: Mark F. Pelini, Valrico, FL (US)

(72) Inventor: Mark F. Pelini, Valrico, FL (US)

( * ) Notice: Subject to any disclaimer, the term of this patent is extended or adjusted under 35 U.S.C. 154(b) by 0 days.

(21) Appl. No.: 15/858,766

(22) Filed: Dec. 29, 2017

(51) Int. Cl.
*B63H 20/10* (2006.01)
*B63H 20/02* (2006.01)

(52) U.S. Cl.
CPC ..... *B63H 20/10* (2013.01); *B63H 20/02* (2013.01)

(58) Field of Classification Search
CPC ..... B63H 20/10; B63H 20/02; B63H 20/08; B63H 20/106
USPC ..... 440/55, 56
See application file for complete search history.

(56) References Cited

U.S. PATENT DOCUMENTS 4,482,330 A * 11/1984 Cook ..... B63H 20/106 248/640
4,778,415 A * 10/1988 Knotts ..... B63H 20/10 248/640
4,826,459 A * 5/1989 Slattery ..... B63H 20/08 440/55

OTHER PUBLICATIONS

Internet advertisernent for spring loaded break-away jack plate.
Internet web site, thmarine.com, break away jack plate.

* cited by examiner

*Primary Examiner* — Anthony D Wiest
(74) *Attorney, Agent, or Firm* — Edward P Dutkiewicz

(57) ABSTRACT

A transom component having an upper arcuate slot threaded bolt hole there through and a lower arcuate slot pin hole there through. There is an associated lower arcuate slot pin. There is a transom cross brace. There is a motor component having an upper arcuate slot there through and a lower arcuate slot there through. There is a motor cross brace. There is a rotation pin and a slot pin.

13 Claims, 7 Drawing Sheets

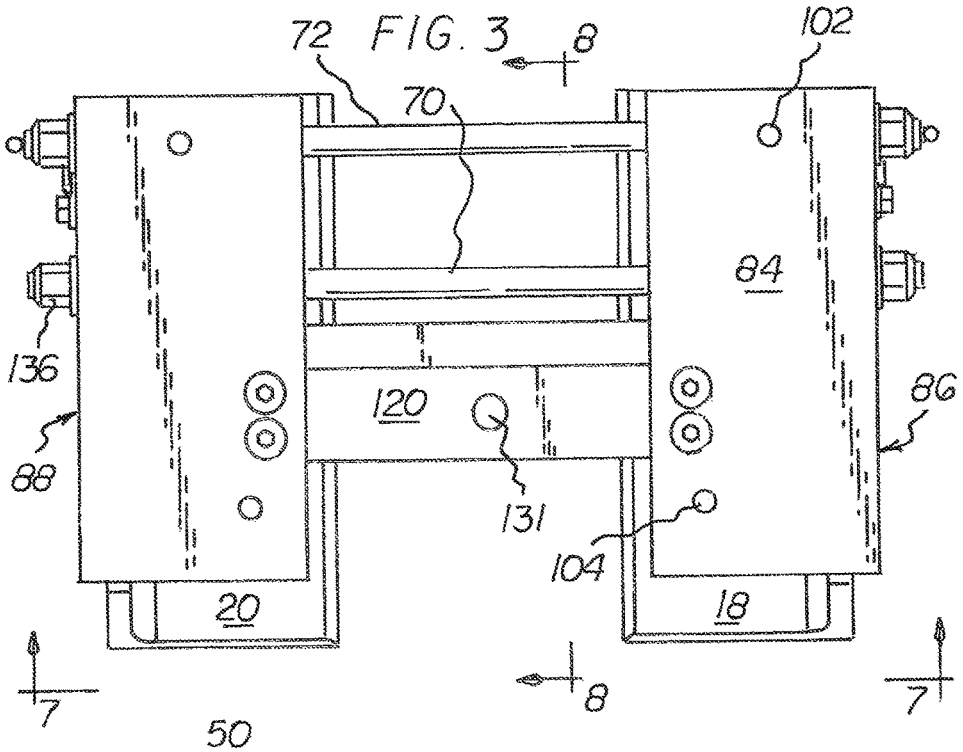
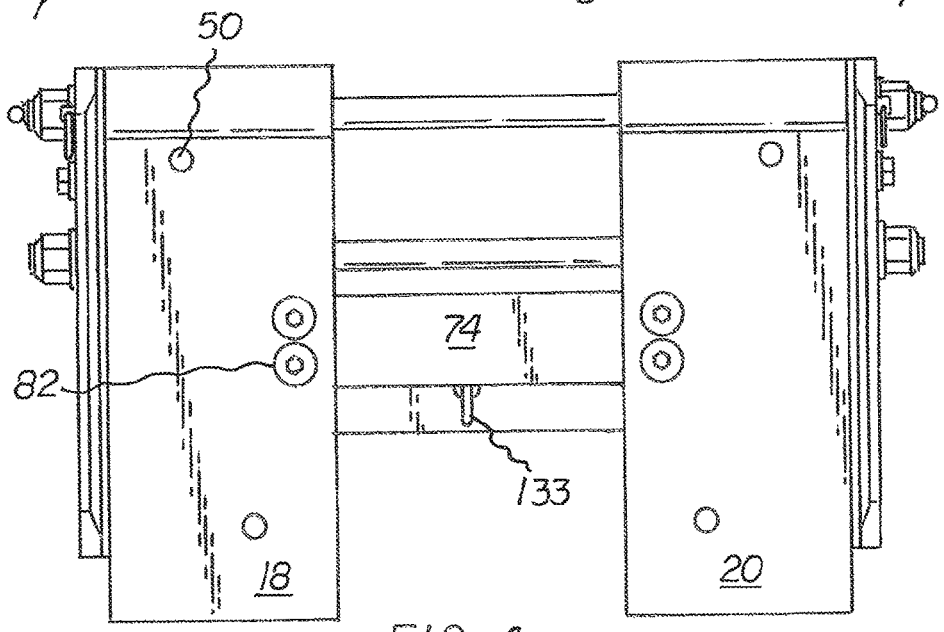
FIG. 4

BREAK AWAY JACK PLATE

BACKGROUND OF THE INVENTION

Rule 1.78 (F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention relates to a break-away jack plate and more particularly pertains to a jack plate which rotates up when the outboard motor strikes a submerged article.

DESCRIPTION OF THE PRIOR ART

The use of devices to rotate jack plates up out of the water is known in the prior art. More specifically, devices to rotate jack plates up out of the water previously devised and utilized for the purpose of protecting outboard motor lower units by rotating the motor up and out of the water are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe break-away jack plate that allows a jack plate to rotate up and then reposition itself back into a operational position by action of the propeller.

In this respect, the break-away jack plate according to the present invention substantially departs from the conventional concepts and designs of the prior art, and in doing so provides an apparatus primarily developed for the purpose of allowing a jack plate to rotate up and then reposition itself back into a operational position by action of the propeller.

Therefore, it can be appreciated that there exists a continuing need for a new and improved break-away jack plate which can be used for rotating a jack plate up when it strikes a submerged article, and then the outboard motor repositioning itself back into a operational position by action of the propeller. In this regard, the present invention substantially fulfills this need.

SUMMARY OF THE INVENTION

In view of the foregoing disadvantages inherent in the known types of devices to rotate jack plates up out of the water now present in the prior art, the present invention provides an improved break-away jack plate. As such, the general purpose of the present invention, which will be described subsequently in greater detail, is to provide a new and improved break-away jack plate which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain the objects of this invention, the present invention essentially comprises a break-away jack plate, comprises several components, in combination.

There is a transom component. The transom component is fabricated of a rigid material. The transom component comprises a pair of mirror imaged, L-shaped, transom plates, being a right L-shaped transom plate and a left L-shaped transom plate. Each of the L-shaped transom plate has a forward transom portion and a rearwardly directed portion. Each of the L-shaped transom plate rearwardly directed portions has an outer side and an inner side, with a thickness there between. Each forward transom portion of each of the L-shaped transom plates has a transom side, comprising a transom surface and a back side, comprising a back surface with a thickness there between. Each of the L-shaped transom plate transom portions has a pair of transom mounting bolt holes there through.

Each L-shaped transom plate rearwardly directed portion has a retention pin hole there, through with an associated retention pin.

Each forward transom portion of each of the L-shaped transom plates has a transom side, comprising a transom surface and a back side, comprising a back surface with a thickness there between. Each L-shaped transom plate transom portion has a pair of transom mounting bolt holes there through, being an upper transom mounting bolt hole and a lower transom mounting bolt hole.

Each L-shaped transom plate transom portion has a pair of cross brace mounting bolt holes there through, being an upper cross brace mounting bolt hole and a lower cross brace mounting bolt hole.

Each L-shaped transom plate rearwardly directed portion has an outer side and an inner side with a thickness there between. Each L-shaped transom plate rearwardly directed portion has a rotation pin hole there through. Each L-shaped transom plate rearwardly directed portion has an upper arcuate slot threaded bolt hole there through and a lower arcuate slot pin hole there through. The upper arcuate slot threaded bolt hole has an associated upper arcuate slot bolt. The lower arcuate slot pin hole has an associated lower arcuate slot pin.

Each L-shaped transom plate rearwardly directed portion has a retention pin hole there through with an associated retention pin. Each L-shaped transom plate rearwardly directed portion has a rotation pin hole there through with an associated rotation pin. The rotation pin hole is located through each of the L-shaped transom plate rearwardly directed portions.

There is a transom cross brace, which is fabricated of rigid material. The transom cross brace has a generally rectilinear configuration with a pair of oppositely located ends, with a length there between. Each of the oppositely located ends of the transom brace has a step-therein. Each of the oppositely located ends of the transom brace has a pair of bolt holes there through. Each transom cross brace bolt hole has an associated transom cross brace bolt.

There is a motor component which is fabricated of a rigid material. The motor component comprises a pair of mirror imaged L-shaped motor plates, being a right L-shaped motor plate and a left L-shaped motor plate. Each L-shaped motor plate has a rearward motor plate portion and a forwardly directed transom portion. Each of the L-shaped motor plate forwardly directed portions has an outer side and an inner side, with a thickness there between. Each rearward motor portion of each of the L-shaped motor plates has a motor side comprising a motor surface, and a forward side comprising a forward surface, with a thickness there between. Each L-shaped motor plate rearward motor portion has a pair of motor mounting bolt holes there through, being an upper motor mounting bolt hole and a lower motor mounting bolt hole.

The rearward motor portion of each of the L-shaped motor plates has a motor side comprising a motor surface, and a forward side comprising a forward surface, with a thickness there between. Each L-shaped motor plate motor portion has a pair of motor cross brace mounting bolt holes there through, being an upper motor cross brace mounting bolt hole and a lower motor cross brace mounting bolt hole.

Each L-shaped motor plate forwardly directed portion has an outer side and an inner side, with a thickness there between. Each L-shaped motor plate forwardly directed portion has a rotation pin hole there through.

Each L-shaped motor plate forwardly directed portion has an upper arcuate slot there through, and a lower arcuate slot there through. The upper arcuate slot bolt passes through the motor plate forwardly directed portion upper arcuate slot and into the threads of the transom plate rearwardly directed portion upper arcuate slot threaded bolt hole. The lower arcuate slot pin passes through the motor plate forwardly directed portion lower arcuate slot and through the lower arcuate slot pin hole of the transom plate rearwardly directed portion.

Each L-shaped transom plate rearwardly directed portion has a retention pin hole there through, which allows the associated retention pin to pass through the retention pin hole of the motor component and through the retention pin hole of the transom component, thereby locking the motor component and the transom component in a fixed orientation. The retention pin has a pin portion, with a spring loaded keeper, and a pivotable grasping loop.

There is a motor cross brace which is fabricated of rigid material. The motor cross brace has a generally rectilinear configuration, with a pair of oppositely located ends, with a length there between. Each of the oppositely located ends of the motor cross brace has a step therein. Each of the oppositely located ends of the motor cross brace has a pair of bolt holes there through. Each motor cross brace bolt hole has an associated motor cross brace bolt. The motor cross brace has a threaded eye-bolt hole there through with the eye-bolt hole having an associated eye-bolt.

The rotation pin is fabricated of rigid material. The rotation pin has round solid tubular configuration. The rotation pin has a right side and a left side, with a length there between. Each side of the rotation pin is threaded. Each side of the rotation pin has a grease channel therein. The rotation pin has a pair of rotation pin nuts, and a pair of rotation pin grease fittings. The rotation pin passes through the rotation pin holes of each of the L-shaped transom plate rearwardly directed portions. The rotation pin passes through rotation pin holes of each of the L-shaped motor plate forwardly directed portions.

The lower arcuate slot pin is fabricated of rigid material. The lower arcuate slot pin has round solid tubular configuration. The lower arcuate slot pin has a right side and a left side, with a length there between. Each side of the lower arcuate pin is threaded. Each side of the lower arcuate pin has a grease channel therein. The lower arcuate pin has a pair of lower arcuate pin nuts and a pair of lower arcuate pin grease fittings. The lower arcuate pin passes through lower arcuate pin holes of each of the L-shaped transom plate rearwardly directed portions. The lower arcuate slot pin passes through lower arcuate pin holes of each of the L-shaped motor plate forwardly directed portions, there by allowing the motor component to slideably move relative to the transom component.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved break-away jack plate which has all of the advantages of the prior art devices to rotate jack plates up out of the water and none of the disadvantages.

It is another object of the present invention to provide a new and improved break-away jack plate which may be easily and efficiently manufactured and marketed.

It is further object of the present invention to provide a new and improved break-away jack plate which is of durable and reliable constructions.

An even further object of the present invention is to provide a new and improved break-away jack plate which is susceptible of a low cost of manufacture with regard to both materials and labor, and which accordingly is then susceptible of low prices of sale to the consuming public, thereby making such break-away jack plate economically available to the buying public.

Even still another object of the present invention is to provide a break-away jack plate for a jack plate which rotates up when the outboard motor strikes a submerged article, with the outboard motor propeller then acting to reposition the outboard motor and jack plate into an operational orientation.

Lastly, it is an object of the present invention to provide a new and improved A transom component having an upper arcuate slot threaded bolt hole there through and a lower arcuate slot pin hole there through. There is an associated lower arcuate slot pin.

There is a transom cross brace. There is a motor component having an upper arcuate slot there through and a lower arcuate slot there through.

There is a motor cross brace. There is a rotation pin and a slot pin.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view taken along line 3-3 of FIG. 1.

FIG. 4 is a view taken along line 4-4 of FIG. 1.

The same reference numerals refer to the same parts throughout the various Figures.

DESCRIPTION OF THE PREFERRED EMBODIMENT

Figure 1:
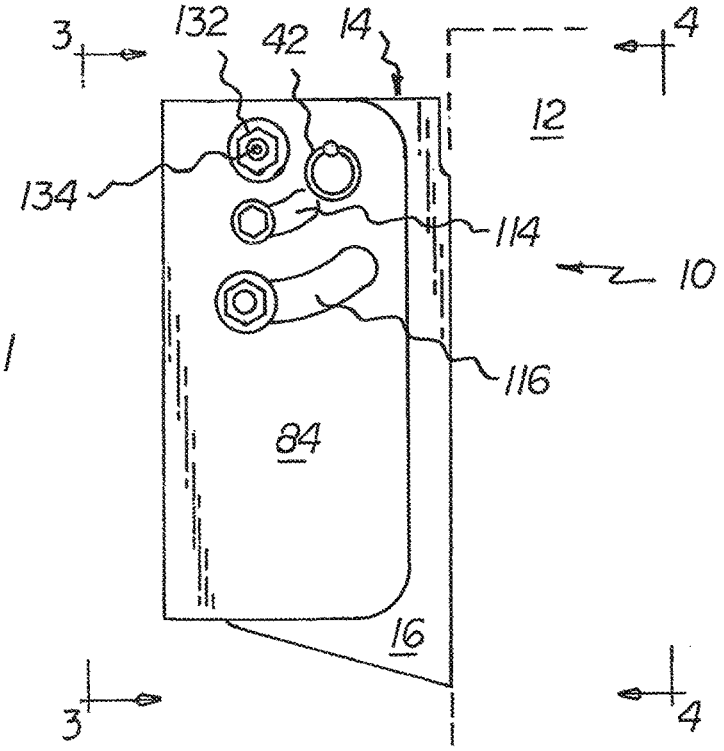
FIG. 1 is a side elevational view in the operational orientation.

With reference now to the drawings, and in particular to FIG. 1 thereof, the preferred embodiment of the new and improved break-away jack plate embodying the principles and concepts of the present invention and generally designated by the reference numeral 10 will be described.

The present invention, the break-away jack plate 10 is comprised of a plurality of components. Such components in their broadest context include a transom component, a motor component, at least one cross member and a rotation pin. Such components are individually configured and correlated with respect to each other so as to attain the desired objective.

A breakaway jack plate 10, comprises several components, in combination.

Figure 2:
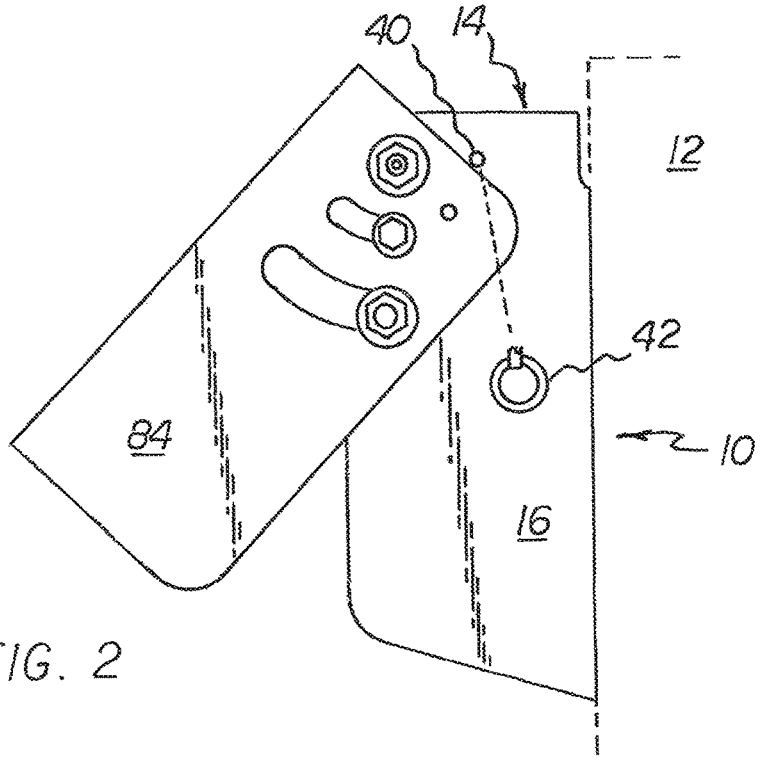
FIG. 2 is a side elevational view in the raised orientation.

There is an existing boat transom 12, which is shown, in phantom, in FIGS. 1 and 2.

There is a transom component 14 which is common to all variations. The transom component is fabricated of a rigid material. The transom component comprises a pair of mirror imaged, L-shaped, transom plates 16, being a right L-shaped transom plate 18 and a left L-shaped transom plate 20. Each of the L-shaped transom plates has a forward transom portion 22 and a rearwardly directed portion 24. Each of the L-shaped transom plate rearwardly directed portions has an outer side 26 and an inner side 28, with a thickness there between.

Each forward transom portion of each of the L-shaped transom plates has a transom side 30, comprising a transom surface 32 and a back side 34, comprising a back surface 36 with a thickness there between. Each of the L-shaped transom plate transom portions has a pair of transom mounting bolt holes 38 there through.

Each L-shaped transom plate rearwardly directed portion has a retention pin hole 40 there through, with an associated retention pin 42. The retention pin has a pin portion 44, with a spring loaded keeper 46, and a pivotable grasping loop 48.

The transom mounting bolt holes run through the forward transom portion of the transom component. The transom mounting bolt holes are an upper transom mounting bolt hole 50 and a lower transom mounting bolt hole 52.

Each L-shaped transom plate transom portion has a pair of cross brace mounting bolt holes 54 there through, being an upper cross brace mounting bolt hole and a lower cross brace mounting bolt hole.

Each L-shaped transom plate rearwardly directed portion has an outer side 56 and an inner side 58 with a thickness there between.

Each L-shaped transom plate rearwardly directed portion has a rotation pin hole 60 there through.

Each L-shaped transom plate rearwardly directed portion has an upper arcuate slot threaded bolt hole 62 there through and a lower arcuate slot pin hole 64 there through.

Figure 9:
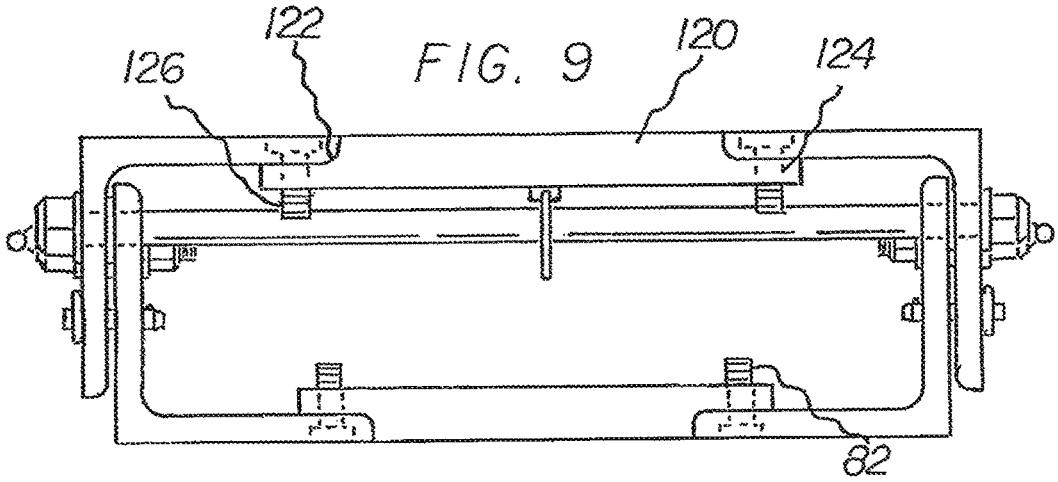
FIG. 9 is a bottom view of a variation of the break-away jack plate, showing a single pin through the upper slot.
Figure 10:
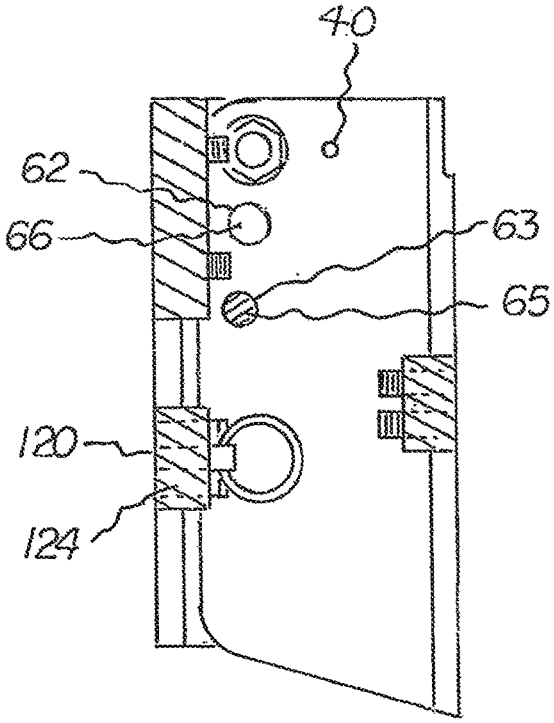
FIG. 10 is a side elevational cross section of the break-away jack plate.
Figure 11:
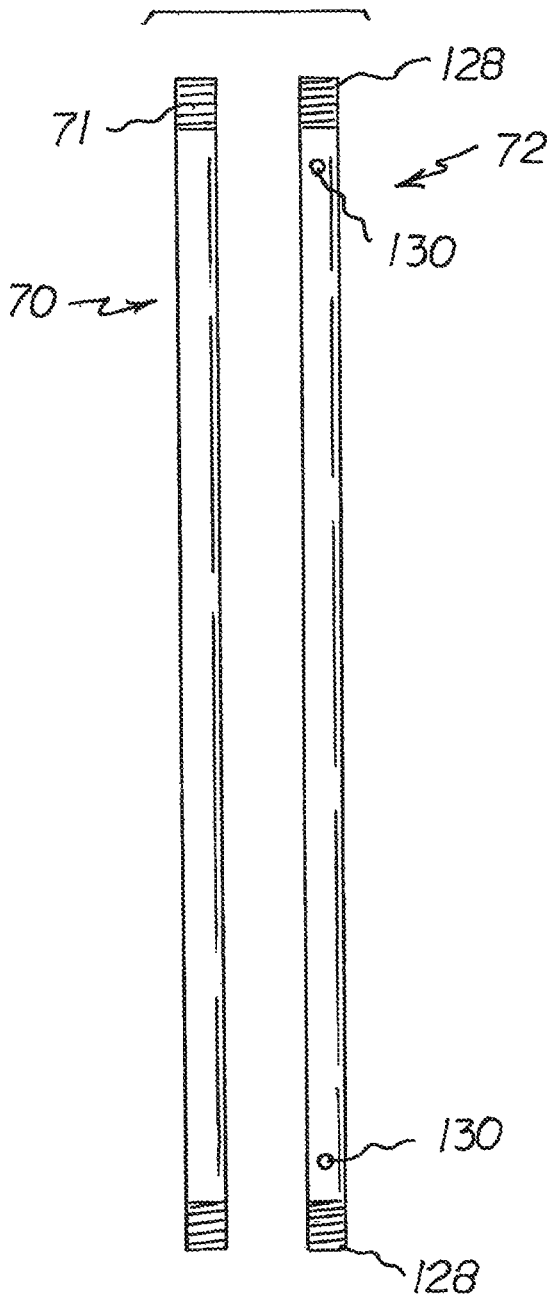
FIG. 11 is a side elevational view of the rotation pin and the slot pin.
Figure 12:
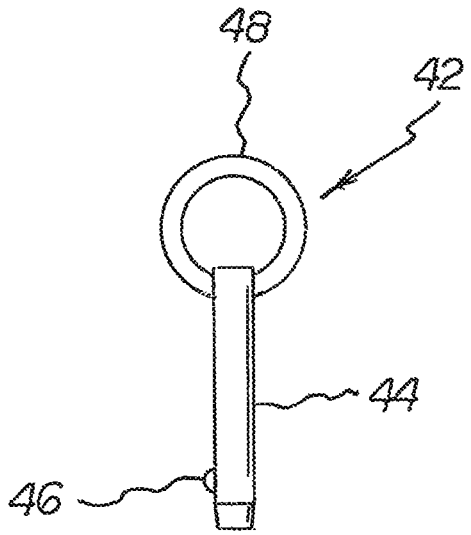
FIG. 12 is a side elevational view of the lynch pin.

In a variation, shown in FIGS. 9 and 10, there is a lower arcuate slot bolt hole 63 in each of the L-shaped transom plate rearwardly directed portion. In this variation, the bolt hole is treaded, and a bolt 65 is used to perform the function of the lower arcuate slot pin. The upper arcuate slot threaded bolt hole has an associated upper arcuate slot bolt 66.

In the preferred embodiment, the lower arcuate slot pin hole 64 has an associated lower arcuate slot pin 70.

Each L-shaped transom plate rearwardly directed portion rotation pin hole has an associated rotation pin 72.

There is a transom cross brace 74, which is fabricated of rigid material. The transom cross brace has a generally rectilinear configuration with a pair of oppositely located ends 76, with a length there between. Each of the oppositely located ends of the transom brace has a step 78 therein. Each of the oppositely located ends of the transom brace has a pair of bolt holes 80 there through. Each transom cross brace bolt hole has an associated transom cross brace bolt 82.

There is a motor component 84 which is fabricated of a rigid material. The motor component comprises a pair of mirror imaged L-shaped motor plates, being a right L-shaped motor plate 86 and a left L-shaped motor plate 88. Each L-shaped motor plate has a rearward motor plate portion 90 and a forwardly directed transom portion 92. Each of the L-shaped motor plate forwardly directed portions has an outer side 94 and an inner side 96, with a thickness there between. Each rearward motor portion of each of the L-shaped motor plates has a motor side comprising a motor surface 98, and a forward side comprising a forward surface 100, with a thickness there between. Each L-shaped motor plate rearward motor portion pair has a pair of motor mounting bolt holes there through, being an upper motor mounting bolt hole 102 and a lower motor mounting bolt hole 104.

Each L-shaped motor plate motor portion has a pair of motor cross brace mounting bolt holes 106 there through, being an upper motor cross brace mounting bolt hole 108 and a lower motor cross brace mounting bolt hole 110.

Each L-shaped motor plate forwardly directed portion has a rotation pin hole 112 there through.

Each L-shaped motor plate forwardly directed portion has an upper arcuate slot 114 there through, and a lower arcuate slot there through 116. The upper arcuate slot bolt passes through the motor plate forwardly directed portion upper arcuate slot and into the threads of the transom plate rearwardly directed portion upper arcuate slot threaded bolt hole. The lower arcuate slot pin passes through the motor plate forwardly directed portion lower arcuate slot and through the lower arcuate slot pin hole of the transom plate rearwardly directed portion.

Each L-shaped transom plate rearwardly directed portion has a retention pin hole 40 there through, which allows the associated retention pin to pass through the retention pin hole of the motor component and through the retention pin hole of the transom component, thereby locking the motor component and the transom component in a fixed orientation.

There is a first motor cross brace 120 which is fabricated of rigid material. The first motor cross brace has a generally rectilinear configuration, with a pair of oppositely located ends, with a length there between. Each of the oppositely located ends of the first motor cross brace has a step 122 therein. Each of the oppositely located ends of the first motor cross brace has a pair of threaded bolt holes 124 there through. Each first motor cross brace bolt hole has an associated motor cross brace bolt 126.

Figure 5:
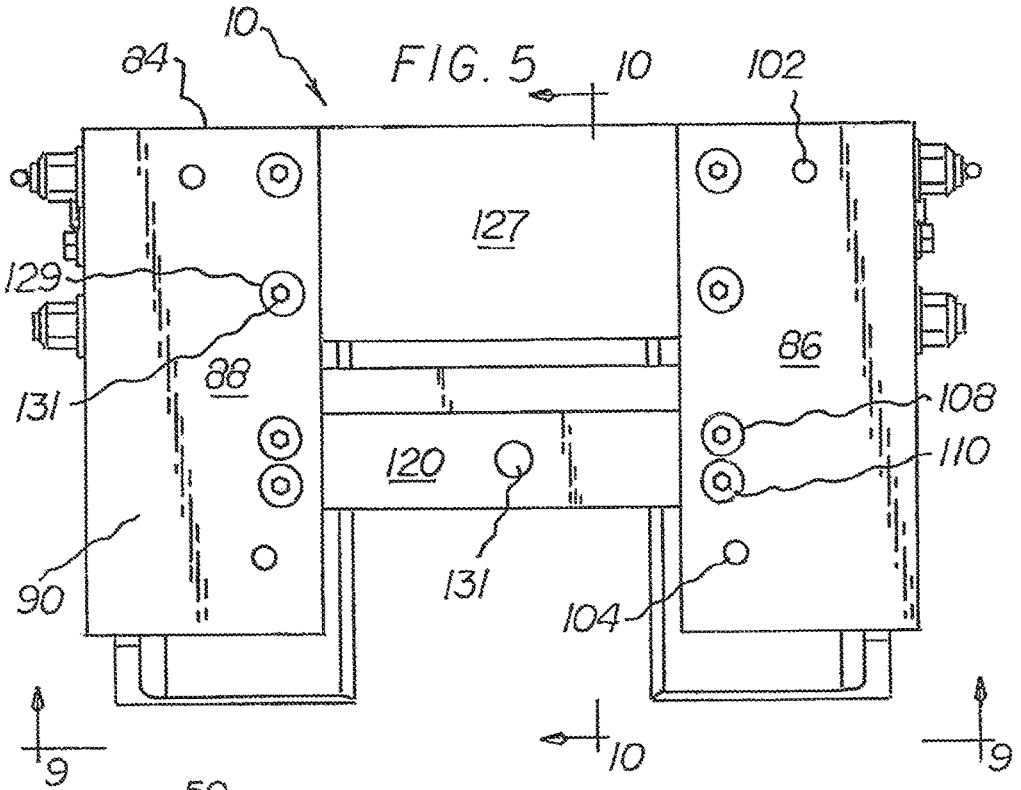
FIG. 5 is a rear elevational view showing the motor component and two cross members.
Figure 6:
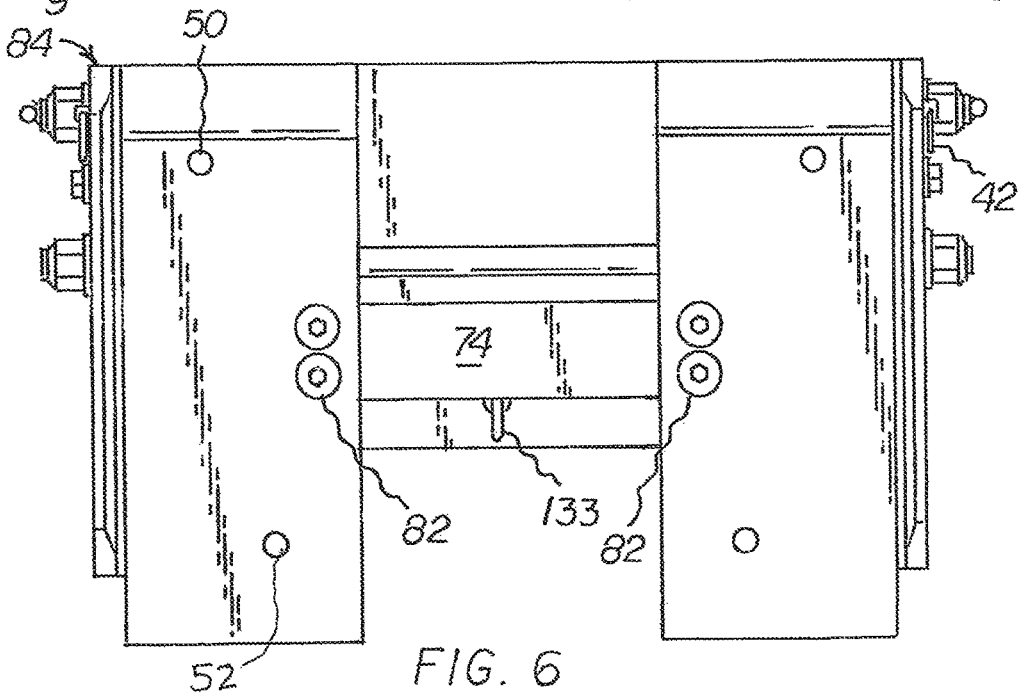
FIG. 6 is a front elevational view showing the transom component and the cross member.
Figure 7:
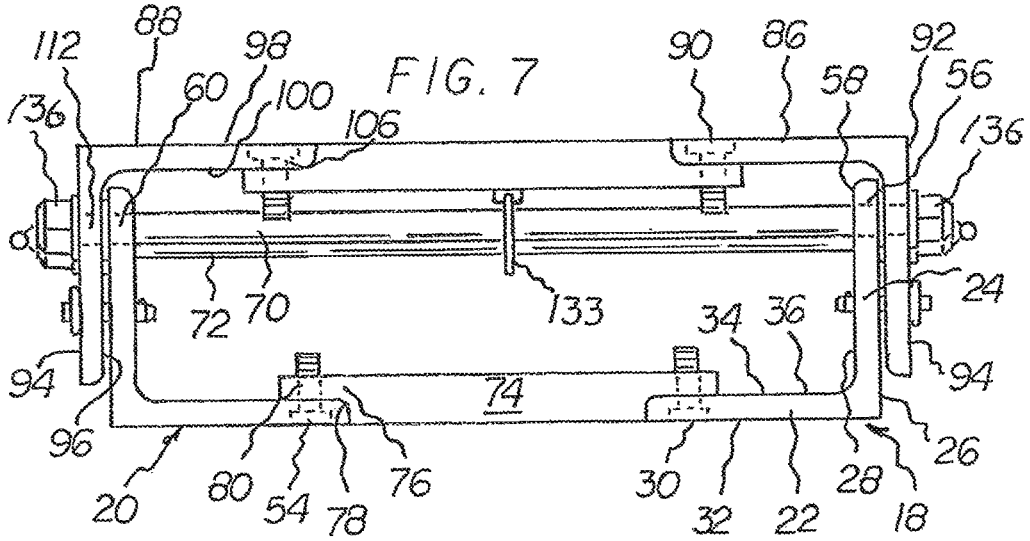
FIG. 7 is a view taken along the line 7-7 of FIG. 3.
Figure 8:
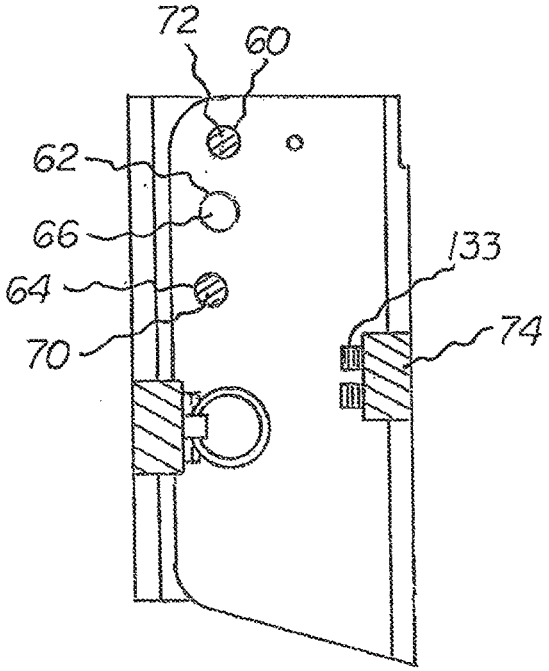
FIG. 8 is a view taken along line 8-8 of FIG. 3.
Figure 13:
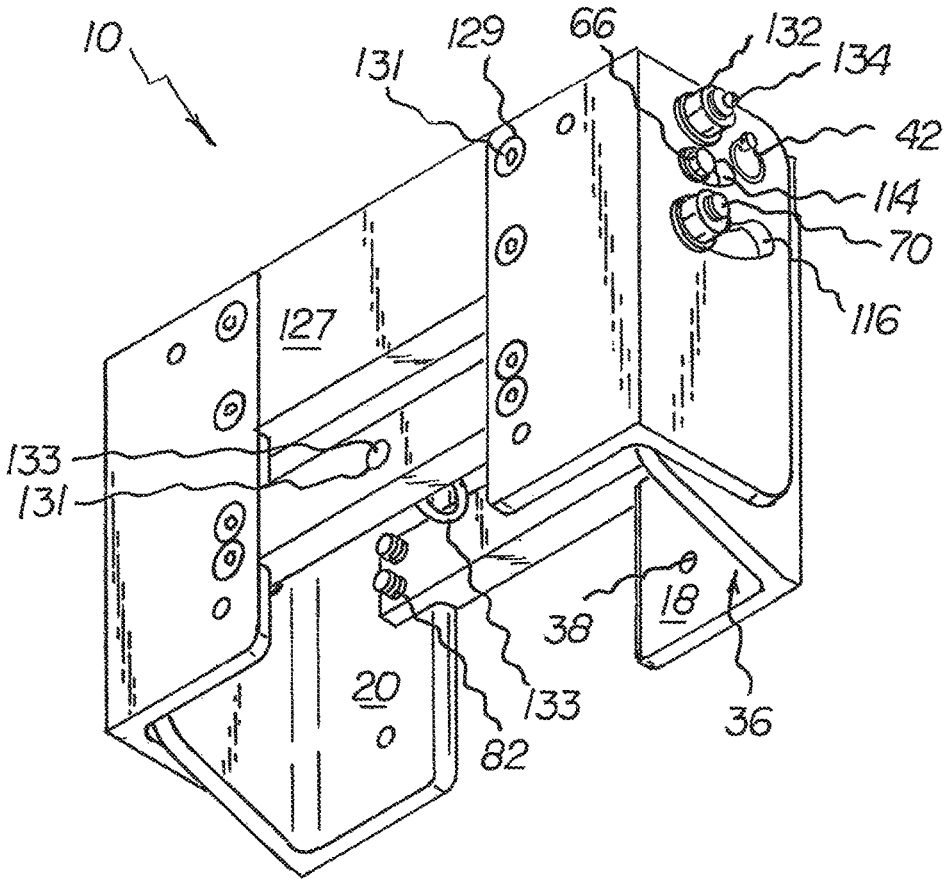
FIG. 13 is a bottom rear perspective of the break-away jack plate.

In a variation, FIGS. 5 and 6, there may be a second motor cross brace 127 which has a similar configuration as the first motor cross brace, having cross brace bolt holes 129 and associated second motor cross brace bolts 131, as shown in FIGS. 5 and 13.

The first motor cross brace has a threaded eye-bolt hole 131 there through with the eye-bolt hole having an associated eye-bolt 133.

The rotation pin is fabricated of rigid material. The rotation pin has round solid tubular configuration. The rotation pin has a right side, and a left side, with a length there between. Each side of the rotation pin is threaded 128. Each side of the rotation pin has a grease channel 130 therein. The rotation pin has a pair of rotation pin nuts 132, and a pair of rotation pin grease fittings 134. The rotation pin passes through the rotation pin holes of each of the L-shaped transom plate rearwardly directed portions. The rotation pin passes through rotation pin holes of each of the L-shaped motor plate forwardly directed portions. In a variation of the embodiment, the rotation pin comprise a pair of bolts, with each bolt having an associated washer and an associated spacer and an associated nut.

The lower arcuate slot pin 70 is fabricated of rigid material. The lower arcuate slot pin has round solid tubular configuration. The lower arcuate slot pin has a right side and a left side, with a length there between. Each side of the lower arcuate pin is threaded 71. The lower arcuate pin has a pair of lower arcuate pin nuts 136. The lower arcuate pin passes through lower arcuate pin holes of each of the L-shaped transom plate rearwardly directed portions. The lower arcuate slot pin passes through lower arcuate pin holes of each of the L-shaped motor plate forwardly directed portions, there by allowing the motor component to slideably move relative to the transom component.

In a variation of the embodiment the rotation pin may be replaced by a pivot means, which consists of at least one of a bolt and nut combination, a rivet, a pin and recess combination, a pin and slot combination, a pin, a tubular structure, a pin and bearing combination, and a pivotal lever. The upper arcuate fixation means consists of at least one of a pin and slot combination, a pin, a tubular structure, a pin and bearing combination, a roller, and a pivotal lever. The lower arcuate fixation means consists of at least one of a pin and slot combination, a pin, a tubular structure, a pin and bearing combination, a roller, and a pivotal lever.

In use, the motor component is universal, which means that the user may mount the motor in any position on the motor component. The arcuate fixation components, both upper and lower, are tightened so as to provide a resistance to movement, so as to adjust and fix the amount of force needed to cause the lifting of the motor, should it strike any submerged article or obstruction. If, and when, the lower outboard motor unit strikes an obstruction, the force of the forward movement of the motor, working against the resistance of the obstruction, causes the motor to overcome the resistance to the lifting of the motor which has been set by the user in tightening the fixation components. This allows the motor to rise, over the obstruction. Given a normal application, the propeller would be behind the transom, but still in the water. As the lower motor unit clears any obstruction, the forward force of the propeller turning the water would overcome the resistance which is set by the tightening of the arcuate fixation components, pushing the lower unit of the outboard motor forward, and resulting in a downward pivot of the motor component around the pivot point, or rotation pin, re-setting the motor in an operational orientation, driving the boat forward.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A breakaway jack plate, comprising, in combination:

a transom component comprising a pair of mirror imaged L-shaped transom plates being a right L-shaped transom plate and a left L-shaped transom plate, with each L-shaped transom plate having a rotation pin hole there through, each L-shaped transom plate having a rearwardly directed portion having an upper arcuate slot threaded bolt hole there through and a lower arcuate slot pin hole there through, the upper arcuate slot threaded bolt hole having an associated upper arcuate slot bolt and the lower arcuate slot pin hole having an associated lower arcuate slot pin;

at least one transom cross brace having a generally rectilinear configuration with a pair of oppositely located ends with a length there between, each of the oppositely located ends of the at least one transom brace having a pair of bolt holes there through, with each transom brace bolt hole having an associated transom brace bolt, the at least one transom cross brace coupling the right L-shaped transom plate and the left L-shaped transom plate;

a motor component comprising a pair of mirror imaged L-shaped motor plates being a right L-shaped motor plate and a left L-shaped motor plate, each L-shaped motor plate having a forwardly directed portion having a rotation pin hole there through, each L-shaped motor plate forwardly directed portion having an upper arcuate slot there through and a lower arcuate slot there through, the upper arcuate slot bolt passing through the motor plate forwardly directed portion upper arcuate slot and into the threads of the transom plate rearwardly directed portion upper arcuate slot threaded bolt hole, the lower arcuate slot pin passing through the motor plate forwardly directed portion lower arcuate slot and through the lower arcuate pin hole of the transom plate rearwardly directed portion lower;

at least one motor cross brace having a generally rectilinear configuration with a pair of oppositely located ends with a length there between, each of the oppositely located ends of the at least one motor cross brace having a plurality of bolt holes there through, with each motor cross brace bolt hole having an associated motor cross brace bolt, the at least one motor cross brace coupling the right L-shaped motor plate and the left L-shaped motor plate;

a rotation pin having round tubular configuration, the rotation pin having a right side and a left side with a length there between, the rotation pin having a plurality of rotation pin nuts and a plurality of rotation pin grease fittings, the rotation pin passing through rotation pin holes of each of the L-shaped transom plate rearwardly directed portions, the rotation pin passing through rotation pin holes of each of the L-shaped motor plate forwardly directed portions, thereby rotatably coupling the transom component and the motor component; and the lower arcuate slot pin having a round tubular configuration, the lower arcuate slot pin having a right side and a left side with a length there between, the lower arcuate slot pin having a plurality of slot pin nuts, the lower arcuate slot pin passing through the lower arcuate slot pin holes of each of the L-shaped transom plate rearwardly directed portions, the lower arcuate slot pin passing through lower arcuate slot of each of the L-shaped motor plate forwardly directed portions, thereby slideably coupling the transom component and the motor component.

2. The break away jack plate as described in claim 1, with the jack plate further comprising:

each of the L-shaped transom plate having a forward transom portion and a rearwardly directed portion, each forward transom portion of each of the L-shaped transom plates having a transom side comprising a transom surface and a back side comprising a back surface with a thickness there between; and each L-shaped motor plate having a rearward motor plate portion and a forwardly directed transom portion.

3. The break away jack plate as described in claim 2, with the jack plate further comprising:

each of the L-shaped transom plate transom portions having a pair of transom mounting bolt holes there through;

each L-shaped transom plate rearwardly directed portion having a retention pin hole there through with an associated retention pin; and the rearward motor portion of each of the L-shaped motor plates having a motor side comprising a motor surface and a forward side comprising a forward surface with a thickness there between.

4. The break away jack plate as described in claim 3, with the jack plate further comprising:

the transom mounting bolt holes of each of the L-shaped transom plate transom portions being an upper transom mounting bolt hole and a lower transom mounting bolt hole;

each of the oppositely located ends of the transom brace having a step therein;

each L-shaped motor plate rearward motor portion having a pair of motor mounting bolt holes there through, being an upper motor mounting bolt hole and a lower motor mounting bolt hole;

each of the oppositely located ends of the motor brace having a step therein;

each side of the rotation pin being threaded; and each side of the lower arcuate slot pin being threaded.

5. The break away jack plate as described in claim 4, with the jack plate further comprising:

each of the L-shaped transom plate transom portions having a plurality of cross brace mounting bolt holes there through;

each L-shaped motor plate motor portion having a plurality of motor cross brace mounting bolt holes there through, being a plurality of upper rotor cross brace mounting bolt holes and a plurality of lower motor cross brace mounting bolt hole; and each side of the rotation pin having a grease channel therein.

6. The break away jack plate as described in claim 5, with the jack plate further comprising the transom cross brace mounting bolt holes being a plurality of upper cross brace mounting bolt holes and a plurality of lower cross brace mounting bolt holes.

7. The break away jack plate as described in claim 6, with the jack plate further comprising:

each of the L-shaped transom plate rearwardly directed portions having an outer side and an inner side with a thickness there between; and each of the L-shaped motor plate forwardly directed portions having an outer side and an inner side with a thickness there between.

8. The break away jack plate as described in claim 7, with the jack plate further comprising:

the rotation pin hole being located through each of the L-shaped transom plate rearwardly directed portions; and each of the L-shaped transom plate rearwardly directed portions having a retention pin hole there through with an associated retention pin.

9. The break away jack plate as described in claim 8, with the jack plate further comprising:

the transom component fabricated of a rigid material;

the transom cross brace fabricated of rigid material;

the motor component fabricated of a rigid material;

the retention pin having a pin portion with a spring loaded keeper and a pivotable grasping loop;

the motor cross brace fabricated of rigid material;

the motor cross brace having a threaded eye-bolt hole there through with the eye-bolt hole having an associated eyebolt; and the rotation pin being fabricated of rigid material.

10. A breakaway jack plate, comprising, in combination:

a transom component having at upper arcuate slot threaded bolt hole there through and a lower arcuate slot pin hole there through, the upper arcuate slot threaded bolt hole having an associated upper arcuate slot bolt and the lower arcuate slot pin hole having an associated lower arcuate slot pin, the transom component comprising a transom plate;

at least one transom cross brace having a plurality of bolt holes there through and a plurality of associated transom brace bolts, the at least one transom cross brace being coupled to the transom plate;

a motor component having an upper arcuate slot there through and a lower arcuate slot there through, the motor component comprising a motor plate, the upper arcuate slot bolt passing through the motor component upper arcuate slot and into the threads of the transom plate threaded slot bolt hole, the lower arcuate slot pin passing through the motor component lower arcuate slot and through the lower arcuate slot pin hole of the transom plate;

at least one motor cross brace having a plurality of bolt holes there through and a plurality of associated motor cross brace bolts, the at least one motor cross brace being coupled to the motor plate; and a rotation pin having a length and two oppositely located ends, the rotation pin coupling the transom component and the motor component.

11. The break away jack plate as described in claim 10, with the jack plate further comprising:

the rotation pin having round solid tubular configuration, the rotation pin having a grease channel there in; and the motor component and the transom component each having a retention pin hole there through with an associated retention pin.

12. The break away jack plate as described in claim 11, with the jack plate further comprising:

the rotation pin having a plurality of rotation pin nuts and a plurality of rotation pin grease fittings; and an eye-bolt being coupled to the motor component cross brace.

13. A breakaway jack plate, comprising, in combination:

a transom component having an upper arcuate slot threaded bolt hole therethrough and a lower arcuate slot pin hole therethrough, the transom component having a pivot means;

at least one transom cross brace being coupled to the transom component;

a motor component having an upper arcuate slot therethrough and a lower arcuate slot there through, the motor component being coupled to the transom component by the pivot means; and at least one motor cross brace being coupled to the motor component.

* * * * *